US007425249B1

(12) United States Patent
Britton

(10) Patent No.: US 7,425,249 B1
(45) Date of Patent: Sep. 16, 2008

(54) SUBSEA SOLAR POWERED TEST STATION WITH VOLTAGE READOUT

(75) Inventor: James N Britton, Houston, TX (US)

(73) Assignee: Deepwater Corrosion Services, Inc., Houston, TX (US)

( * ) Notice: Subject to any disclaimer, the term of this patent is extended or adjusted under 35 U.S.C. 154(b) by 362 days.

(21) Appl. No.: 11/273,319

(22) Filed: Nov. 14, 2005

(51) Int. Cl.
*C23F 13/06* (2006.01)

(52) U.S. Cl. ..... 204/196.27; 204/196.02; 204/196.06; 204/196.07; 204/196.1; 204/196.21; 204/196.33; 204/196.36; 204/196.37

(58) Field of Classification Search ..... 204/196.21, 204/196.27, 196.33, 196.36, 196.37, 196.02, 204/196.06, 196.07, 196.1
See application file for complete search history.

(56) References Cited

U.S. PATENT DOCUMENTS

| | | | | |
|---|---|---|---|---|
| 5,139,634 | A * | 8/1992 | Carpenter et al. | 205/727 |
| 5,452,262 | A * | 9/1995 | Hagerty | 367/6 |
| 2002/0041238 | A1* | 4/2002 | Johnson et al. | 340/870.28 |

* cited by examiner

*Primary Examiner*—Bruce F Bell
(74) *Attorney, Agent, or Firm*—Jennifer S. Sickler; Gardere Wynne Sewell LLP

(57) ABSTRACT

Apparatus 10 discloses a subsea monitoring station using solar cells to energize at least one electronic circuit incorporating at least one node having a determinable circuit value or other parameter test station providing a full time voltage readout, powered by the lights 16 on an ROV/AUV 14 or diver's lamp. An additional element of the apparatus is a subsea cathodic protection test station 18 incorporating a plurality of banks of solar cells 28 powering DC voltage test circuits having some form of parameter display, such as voltmeter readout 30, deriving voltage from ambient light 16 provided by outside sources, such as an ROV 14 or diver's lamp. The apparatus's cathodic protection test system includes four integral voltmeters 30 of which are powered with independent solar panels 28. The solar panels 28 are powered by artificial light 16 delivered by diver or submersible vehicle 14. The test station 18 includes sensors 48 that are hard wired back to the solar powered voltage readouts contained within the subsea pressure housing 32. The readout unit 20 can be incorporated into the structure being monitored, the cathodic protection anode source or can be integrated into a buoyant module 42 which floats above the sea bed.

22 Claims, 7 Drawing Sheets

SUBSEA SOLAR POWERED TEST STATION WITH VOLTAGE READOUT

BACKGROUND OF THE INVENTION

1. Field of the Invention

The present invention relates generally to test stations and, more specifically, to subsea test stations using solar cells to energize at least one electronic circuit incorporating at least one node having a determinable circuit value or other parameter test station providing a full time voltage readout, powered by the lights on an ROV/AUV or diver's lamp.

An additional element of the present invention is a subsea cathodic protection test station incorporating a plurality of banks of solar cells powering DC voltage test circuits having some form of parameter display, such as voltmeter readout, deriving voltage from ambient light provided by an outside sources, such as an ROV or diver's lamp.

Cathodic protection effectively protects underground or submerged metallic structures through the use of a negative potential applied by an external source to the structure. Commonly, once the structure has been made sufficiently negative, environmental corrosion (soil or moisture) is resisted. The method is typically applied to iron or steel structures such as underground pipelines, storage tanks, the interior of water storage tanks, ocean pilings, and electrical transmission towers. Buried steel structures will revert back to their natural state as an iron oxide without proper intervention.

Cathodic protection systems require routine monitoring to ensure that adequate current is supplied to buried or submerged metallic structures. Test stations are a simple method for conducting this monitoring.

The cathodic protection test system of the present invention provides means for improved monitoring of submerged cathodic protection systems by utilizing solar panels to power the cathodic protection test system. The solar power extends the life of the system by eliminating the need for internal batteries and thus reduces replacement cost of materials and labor.

The present invention's cathodic protection test system includes four integral voltmeters of which are powered with independent solar panels. The solar panels are powered by artificial light delivered by diver or submersible vehicle.

The test station includes sensors that are hard wired back to the solar powered voltage readouts contained within the subsea pressure housing. The readout unit can be incorporated into the structure being monitored the cathodic protection anode source or can be integrated into a buoyant module which floats above the seabed.

The integral voltmeters of which are powered with independent solar panels include displayed parameters for monitoring cathodic protection status such as reference electrode potentials, subsea shunted devices such as, current density and anode current.

In addition to monitoring cathodic protection status parameters, the solar powered test station may be utilized to monitor any other parameters that can be displayed as a DC voltage. Such parameters include, but are not limited to temperature, pressure, or flow rate.

2. Description of the Prior Art

There are other devices designed for displaying variables. Typical of these is U.S. Pat. No. 2,780,765 issued to Chapin et al on Feb. 5, 1957.

Another patent was issued to Paradise on Jun. 2, 1959 as U.S. Pat. No. 2,889,490. Yet another U.S. Pat. No. 3,317,809 was issued to Bowers, et al. on May 2, 1967 and still yet another was issued on Jul. 11, 1978 to Durand et al as U.S. Pat. No. 4,100,427.

Another patent was issued to Carpenter et al. on Aug. 18, 1992 as U.S. Pat. No. 5,139,634. Yet another U.S. Pat. No. 5,164,654 was issued to Bertram, et al. on Nov. 17, 1992. Another was issued to Janda, et al. on Jun. 22, 1993 as U.S. Pat. No. 5,221,891 and still yet another was issued on Mar. 1, 1994 to Bingley, et al. as U.S. Pat. No. 5,289,998.

Another patent was issued to Henno, et al. on Dec. 2, 2003 as U.S. Pat. No. 6,657,179. Yet another International Patent Application No. WO 00/48166 was issued to Hubbell on Aug. 17, 2000. Another was issued to Erban on Sep. 12, 2000 as International Patent Application No. WO 02/071571 and still yet another was issued on Jan. 20, 2001 to Ogawa, et al. as Canadian Patent No. CA2159511.

U.S. Pat. No. 2,780,765

Inventor: Daryl M. Chapin, et al.

Issued: Feb. 5, 1957

Arrangement for utilizing solar radiation for keeping charged a storage battery comprising a storage battery to be charged, at least one photosensitive element comprising a silicon body including an n-type zone contiguous with a p-type zone including a concentration of boron impurities, the thickness of the p-type zone being of the order of the diffusion length of electrons therein, and a unilaterally-conductive element serially connected with said storage battery and photosensitive element, and poled to pass charging currents developed by the photosensitive element and to block discharging currents from the battery through the photosensitive element.

U.S. Pat. No. 2,889,490

Inventor: Maurice E. Paradise

Issued: Jun. 2, 1959

In combination: a storage battery; a solar cell coupled in charging relationship across said battery; a bias resistor connected in series with said battery and said solar cell; a series-connected resistor and capacitor combination coupled across said battery; and an inert gas filled triode tube having two terminal electrodes coupled across said capacitor, and having a control electrode coupled to the junction of said bias resistor and said solar cell whereby said tube is biased against conduction during light reception by said solar cell.

U.S. Pat. No. 3,317,809

Inventor: Grover W. Bowers, et al.

Issued: May 2, 1967

In combination, a self-contained electric light which comprises a battery, an electric light connected in an operative circuit with said battery, a first bank of solar cells connected in circuit with said battery for recharging thereof, a second bank of solar cells, a relay in an operative circuit with said second bank of solar cells, and a two-way switch in the circuits of said battery, light and first bank of solar cells adapted in one position of movement to complete only a circuit through said battery and first bank of solar cells for recharging of the former by the latter and in the other position of movement to complete only a circuit through said light and battery for illumination of the former by the latter.

U.S. Pat. No. 4,100,427

Inventor: Henri Durand, et al.

Issued: Jul. 11, 1978

A device is described for converting solar energy into electric power for a load, which device is provided with photocells and electric accumulators. Switching means are provided which at least during starting of the load connect this load to the output terminals of the array of photocells so that during starting the current through the load is determined by the current supplied by the photocells. The device makes efficient use of the available solar radiation, is of simple design and is reliable.

U.S. Pat. No. 5,139,634

Inventor: Ronald L. Carpenter, et al.

Issued: Aug. 18, 1992

This invention relates to a dual bed cathodic protection system with automatic controls and method of use utilizing an impressed cathodic protection anode assembly powered through a solar power supply in conjunction with a sacrificial cathodic protection anode assembly which is known in the prior art to use a corrosion element to emit the necessary electrical current to protect a structure assembly from the effects of corrosion. The dual bed cathodic protection system with automatic controls includes 1) a solar power supply to receive sun power from a solar panel; 2) a ground bed assembly which may either be a deep well or surface type; 3) a system automatic control assembly operable to control selected use of either an impressed or sacrificial protection anode assembly; and 4) a protected structure buried within the ground to receive an electrical current to prevent corrosion thereto.

U.S. Pat. No. 5,164,654

Inventor: Leo Bertram, et al.

Issued: Nov. 17, 1992

A charging device for accumulator-operated small electrical appliances, for example, electric dry-shavers, which are energized by rechargeable accumulators which can be charged by means of a charging device including solar cells. The charging device includes an energy buffer which is connected parallel to the solar cells for buffering the solar energy when the charge capacity of the solar cells is below the charge current threshold of the accumulator. The buffered solar energy is supplied to the accumulator when a discharge current of the energy buffer exceeds the charge current threshold of the accumulator and flows until the discharge current falls below the charge current threshold.

U.S. Pat. No. 5,221,891

Inventor: Rudolph W. Janda, et al.

Issued: Jun. 22, 1993

An inexpensive circuit for controlling the recharging of a rechargeable power source by a photovoltaic panel is used for powering a load such as the lamp of a walk light. Using a minimum number of components, the circuit can charge a rechargeable battery anytime sunlight is sufficient to place a potential across the battery that is greater than the present potential of the battery, can sense a decrease in voltage across the photovoltaic panel with diminishing ambient light and energize the load, can prevent the load from being energized when the ambient light level is sufficient to re-charge the battery, can provide positive feedback at turn-on of the load, thereby hastening turn-on and providing hysteresis, can provide for adjusting the hysteresis bands, can shift the turn-on and turn-off thresholds, and can provide an adequate current to guarantee turn-on when using low leakage solar panels. A further embodiment can additionally exhibit hysteresis at load turn-off so that the load does not cycle on and off and can further raise the load turn-off threshold above the level where the battery is substantially discharged, thereby hastening recharging of the battery. A still further embodiment provides temperature compensation for improved performance.

U.S. Pat. No. 5,289,998

Inventor: John D. Bingley, et al.

Issued: Mar. 1, 1994

A solar cell voltage regulating arrangement which is particularly advantageous for use in spacecraft includes a light valve such as a liquid crystal cell disposed before the solar cell, to thereby controllably vary the light transmission to the solar cell. A control arrangement varies the transmission of the liquid crystal to control the output voltage.

U.S. Pat. No. 6,657,179

Inventor: Christiane Henno

Issued: Dec. 2, 2003

A light sensor having increased sensitivity and improved reaction speed includes a phototransistor and a source-follower transistor as an impedance converter for a potential of a main electrode of the phototransistor, and a second transistor as a feedback element between the second main electrode of the phototransistor and its control electrode.

International Patent Application Number WO 00/48166

Inventor: David Hubbell

Published: Aug. 17, 2000

An illuminated sign comprises a front lens having a sign legend; an electroluminescent panel disposed behind the lens to provide lighting to the sign legend; a power source operably connected to the electroluminescent panel; a first sensor responsive to the headlights of an approaching vehicle and connected to the electroluminescent panel to activate the electroluminescent panel upon detection of the headlights; and a second sensor responsive to ambient light and connected to the electroluminescent panel such that the electroluminescent panel is OFF during daylight.

International Patent Application Number WO 02/071571

Inventor: Christof Erban

Issued: Sep. 12, 2002

In a solar module comprising a plurality of individual solar cells connected together electrically in series, with at least one solar cell exposed to the same conditions and not linked to the other solar cells, which serves as sensor of the instantaneous incident light on the solar module and with a switching device able to be slaved at least indirectly to the sensor so as to act on the output electric power of the solar module, according to the invention, at least two solar cells which are disposed a large distance apart, are provided as sensors whose output voltages or currents are conveyed to an evaluation circuit and are compared with one another by the latter, and the evaluation circuit connects by means of the switching device a shunt which bypasses the series circuit of the solar cells of the solar module when a difference which exceeds a threshold value exists between the outputs of the two sensors.

Canadian Patent Number CA 2 159 511

Inventor: Taro Ogawa

Issued: Jan. 30, 2001

An object of the present invention is to provide a simple, economical and safety driving device adapted to automatically operate when detecting solar rays, and an automatic ventilator system employing the same driving device. An electric motor is connected to a relay switch of a one-circuit-two-contact type, and the relay switch is then connected to a limit switch of a one-circuit-two-contact type and a photosensor switch of a one-circuit-one-contact type. The limit switch is connected between the relay switch and a power supply, and a manual main switch is connected between the photosensor switch and the power supply. When the intensity of illumination of solar rays exceeds a threshold value of 3500 lux with the main switch kept normally on, the photosensor detects it, the contact position of the switch is switched from a to b to turn on the switch. Then, power is supplied to the relay switch and the contact position thereof is also changed from a to b to turn the switch on. If the contact position of the limit switch stays at b, the electric motor is energized and starts to operate. The electric motor is interlocked with a ventilating door via a power transmission member, and the ventilating door is gradually opened. When the electric motor continues to operate for a certain period of time, the limit switch is brought into engagement with the power transmission member, and this changes the contact position thereof from b to a, the switch being then turned off. Therefore, the electric motor is brought to a halt, and the ventilating door interlocked with the electric motor can automatically be kept open without the manual switch being operated. In addition, although the main switch is normally kept on, it functions as a safety switch for forcibly stopping the device when it is not used for a long period of time or at the time of maintenance.

While these metering and illuminable devices may be suitable for the purposes for which they were designed, they would not be as suitable for the purposes of the present invention, as hereinafter described.

SUMMARY OF THE PRESENT INVENTION

The present invention discloses a subsea monitoring station using solar cells to energize at least one electronic circuit incorporating at least one node having a determinable circuit value or other parameter test station providing a full time voltage readout, powered by the lights on an ROV/AUV or diver's lamp. An additional element of the present invention is a subsea cathodic protection test station incorporating a plurality of banks of solar cells powering DC voltage test circuits having some form of parameter display, such as voltmeter readout, deriving voltage from ambient light provided by outside sources, such as an ROV or diver's lamp. The present invention's cathodic protection test system includes four integral voltmeters of which are powered with independent solar panels. The solar panels are powered by artificial light delivered by diver or submersible vehicle. The test station includes sensors that are hard wired back to the solar powered voltage readouts contained within the subsea pressure housing. The readout unit can be incorporated into the structure being monitored, the cathodic protection anode source or can be integrated into a buoyant module which floats above the sea bed. The integral voltmeters of which are powered with independent solar panels include displayed parameters for monitoring cathodic protection status such as reference electrode potentials, subsea shunted devices such as, current density and anode current. In addition to monitoring cathodic protection status parameters, the solar powered test station may be utilized to monitor any other parameters that can be displayed as a DC voltage. Such parameters include, but are not limited to temperature, pressure, or flow rate.

A primary object of the present invention is to provide a subsea meter for displaying DC voltages.

Another object of the present invention is to provide a subsea meter having a housing with a transparent front wall lens with a spaced away display having a plurality of solar cells thereon.

Yet another object of the present invention is to provide a subsea meter wherein said solar cells power at least one circuit incorporating a digital display of voltage from a locally hard-wired sensor.

Still yet another object of the present invention is to provide a subsea meter wherein said solar powered meter is positioned away from the metered article within a buoyant housing by a tether.

Still yet another object of the present invention is to provide a subsea meter wherein said tether. Carries the wires to the sensors deployed on or around the equipment being monitored.

Additional objects of the present invention will appear as the description proceeds.

The present invention overcomes the shortcomings of the prior art by providing a subsea solar powered permanent cathodic protection test station providing a full time readout, powered by the lights on an ROV, or a diver's lamp. The test station includes sensors that are hard wired back to the solar powered voltage readouts contained within the subsea pressure housing. The readout unit can be incorporated into the structure being monitored or can be integrated into a buoyant module which floats above the seabed.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
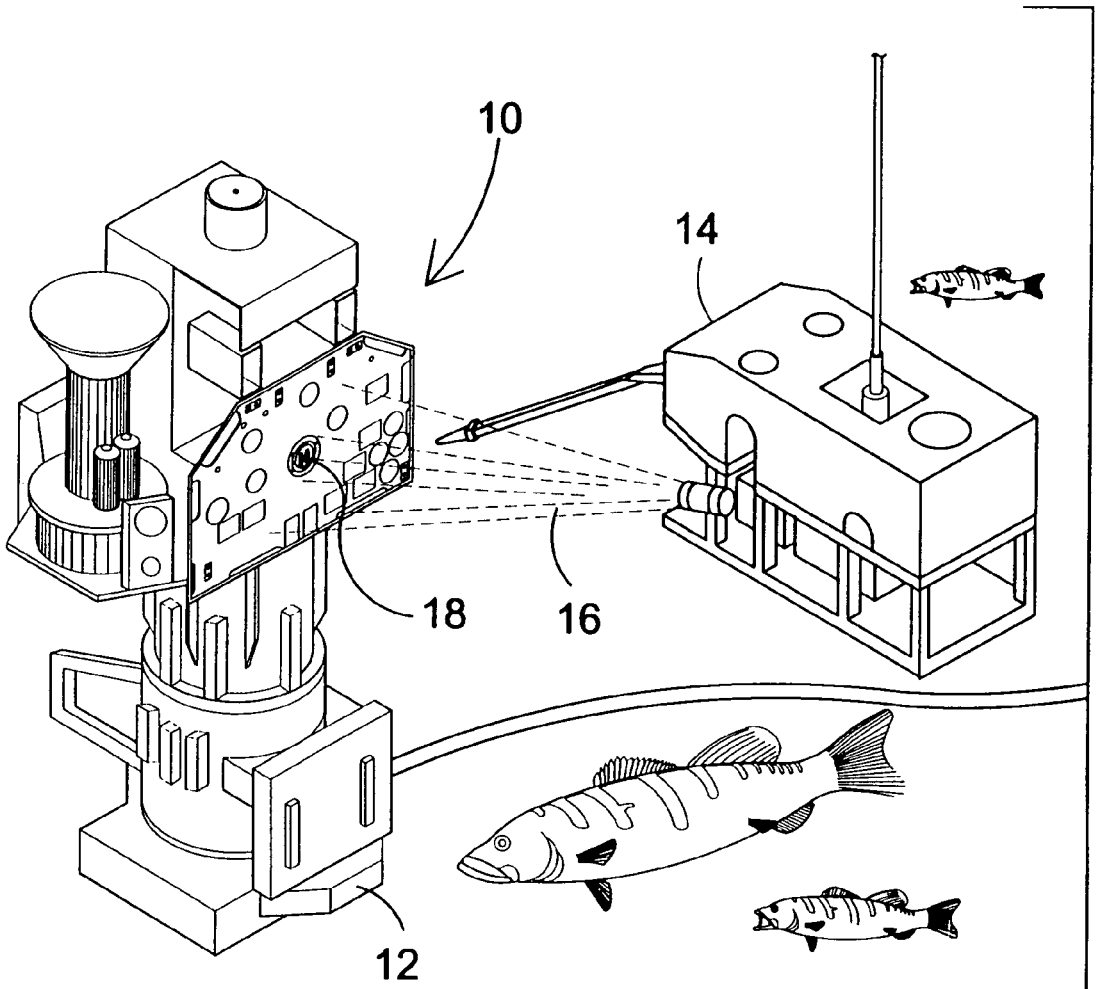
FIG. 1 is an illustrative view of the present invention in use.

With regard to reference numerals used, the following numbering is used throughout the drawings.

10 present invention
12 subsea structure
14 ROV
16 light
18 CP monitoring station
20 CP station readout
22 bezel
24 lens
26 retainer ring
28 solar panel
30 voltmeters
32 pressure housing
34 underwater connection
36 sensor connectors
38 junction box
40 reference ground connection
41 channels
42 buoyant readout
44 subsea pipeline
46 tether
48 sensors
50 clamp
52 CP anode sled

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. Shown is the present invention 10 employed on a subsea structure 12, e.g., a wellhead, as a permanent CP (cathodic protection) test or monitoring station 18. The solar powered device 10 can be used in any survey application, where a ROV (remotely operated vehicle) or AUV (autonomous underwater vehicle) 14 or diver is employed. The test system 18 includes four integral voltmeters connected respectively to independent solar panels that derive power from artificial light 16 delivered by a diver or ROV 14.

Figure 2:
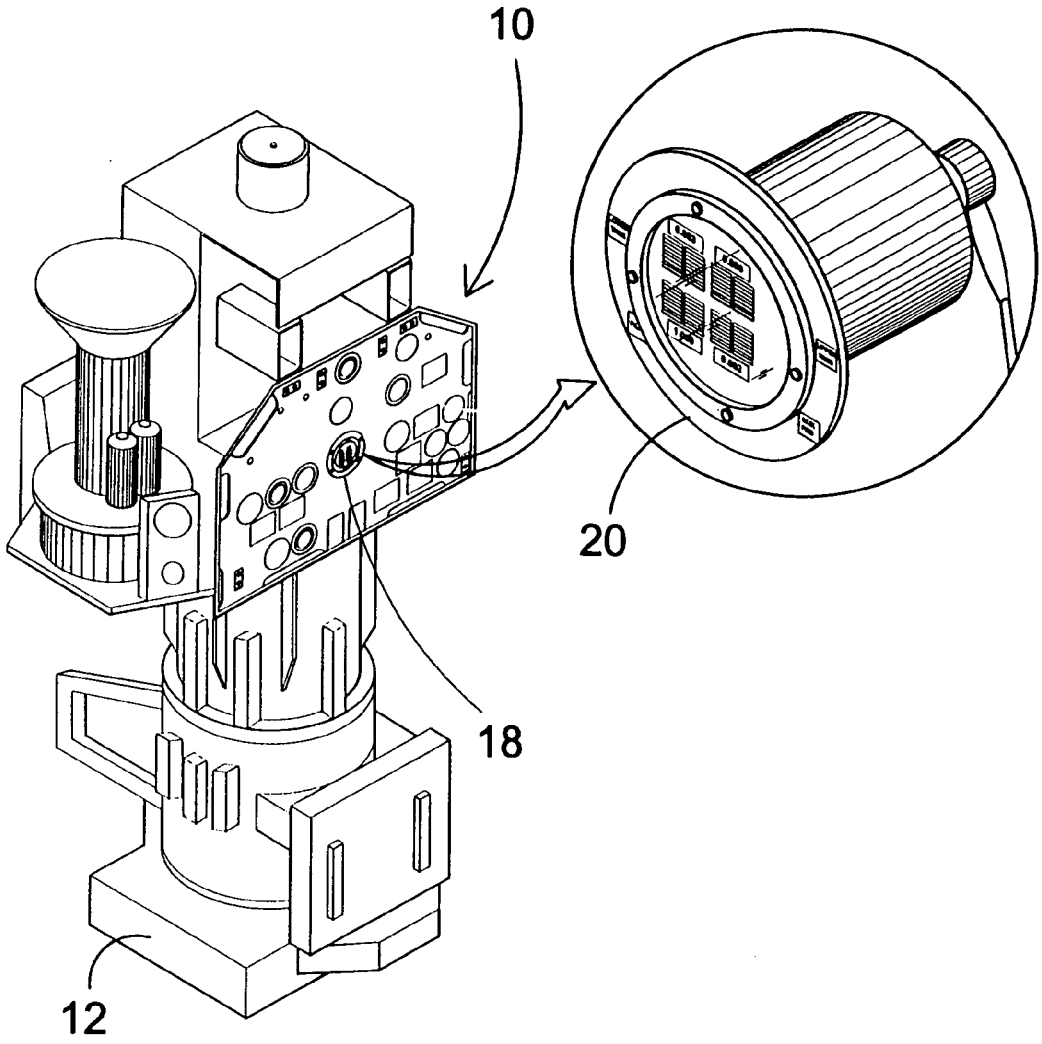
FIG. 2 is a perspective view of the present invention.

Turning to FIG. 2, shown therein is a perspective view of the present invention 10. The present invention 10 discloses a subsea solar powered permanent cathodic protection test station 18, which includes a CP station readout 20 having four integral voltmeters that are powered with independent solar panels. The integral voltmeters include displayed parameters for monitoring cathodic protection status such as reference electrode potentials, subsea shunted devices such as, current density sensors and anode current monitors. In addition to monitoring cathodic protection status parameters, the solar powered test station 18 may be utilized to monitor any other parameters that can be displayed as a DC voltage. Such parameters include, but are not limited to temperature, pressure, or flow rate. Also shown is subsea wellhead structure 12.

Figure 3:
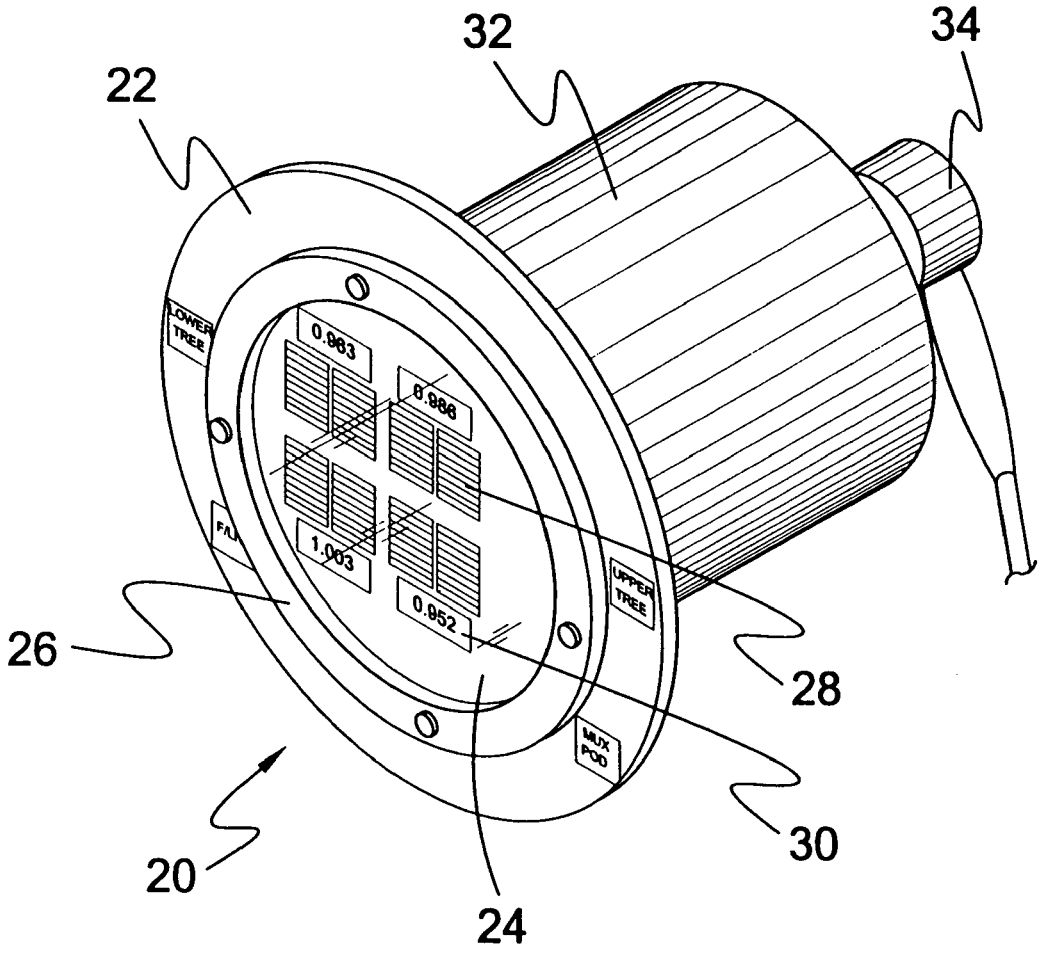
FIG. 3 is a detail view of a readout unit of the present invention.

Turning to FIG. 3, shown therein is a detail view of a readout unit of the present invention. Shown is the readout module 20 of the present invention's subsea solar powered permanent cathodic protection test station. The readout module provides a real time readout powered by the subsea inspection lighting. The module contains 4 channels each with an independent ground. Anode currents can now be read directly in real numbers as can current densities. The readouts 20 are strategically located at locations where ROV intervention is required; CP inspection is achieved whenever the ROV or diver visits. A bezel 22 around the unit 20 includes nomenclature that identifies inspection-point location information and the designation of each channel. The digital display and solar panels are protected by an acrylic lens 24 that is secured by a retainer ring 26. The retainer ring 26 also provides means to restrict marine fouling on the lens. Also shown are four solar panels 28, four voltmeters 30, waterproof pressure housing 32 and underwater connection 34 monitoring instruments.

Figure 4:
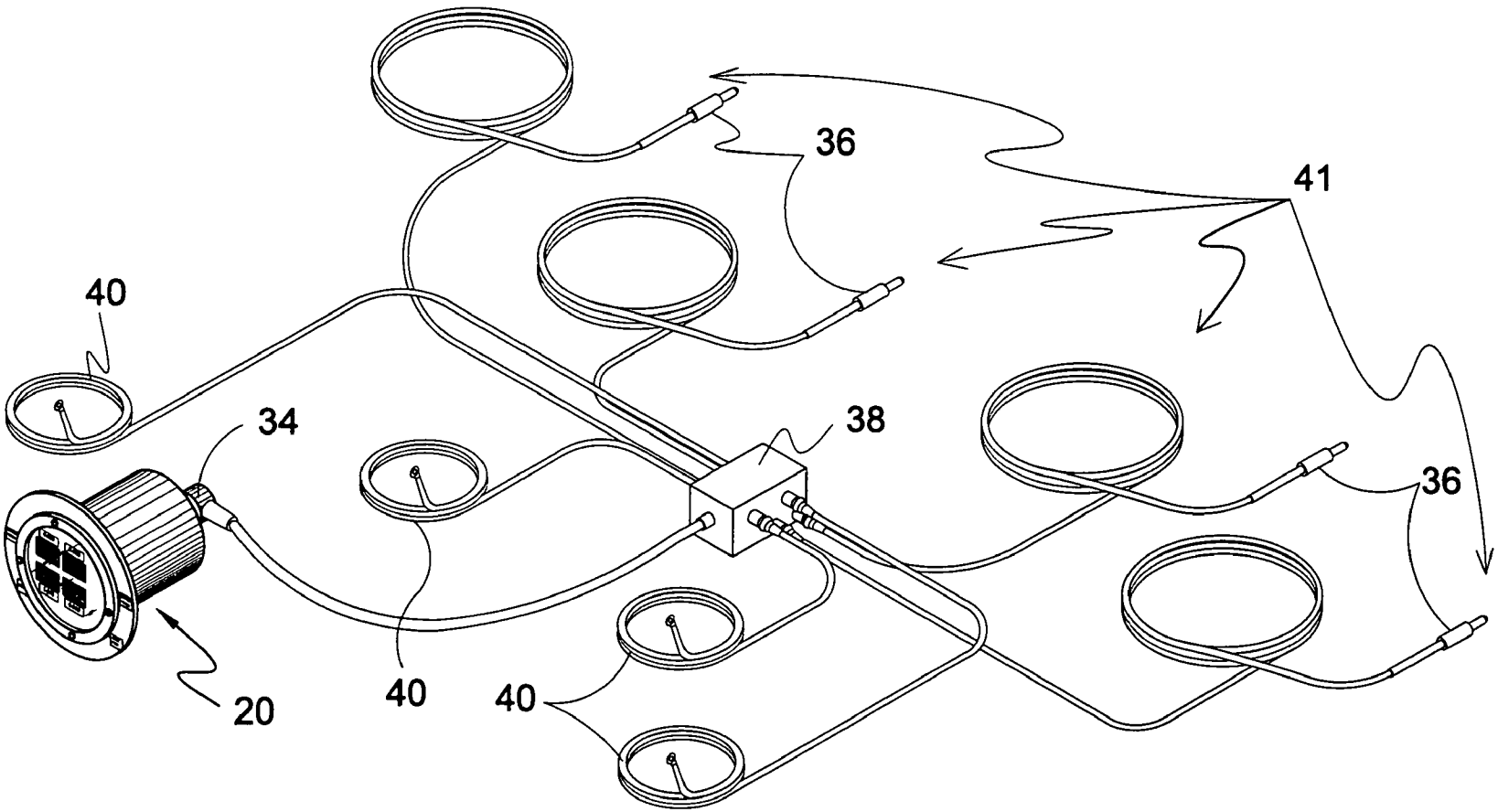
FIG. 4 is a perspective view of the present invention.

Turning to FIG. 4, shown therein is a perspective view of the present invention. Depicted in FIG. 4 is the readout module 20 of the present invention's subsea solar powered permanent cathodic protection test station connected to the independent sensor inputs 36. The four independent sensors 36 are interconnected to the readout module 20 by means of an underwater connector wired into a junction box 38. Each of the four channels at 41 include an independent reference ground connection 40 and reference electrodes (−)ve connection at 36. Although inputs may be substituted to display any parameter that can be displayed as DC voltage. Also shown is underwater connection 34.

Figure 5:
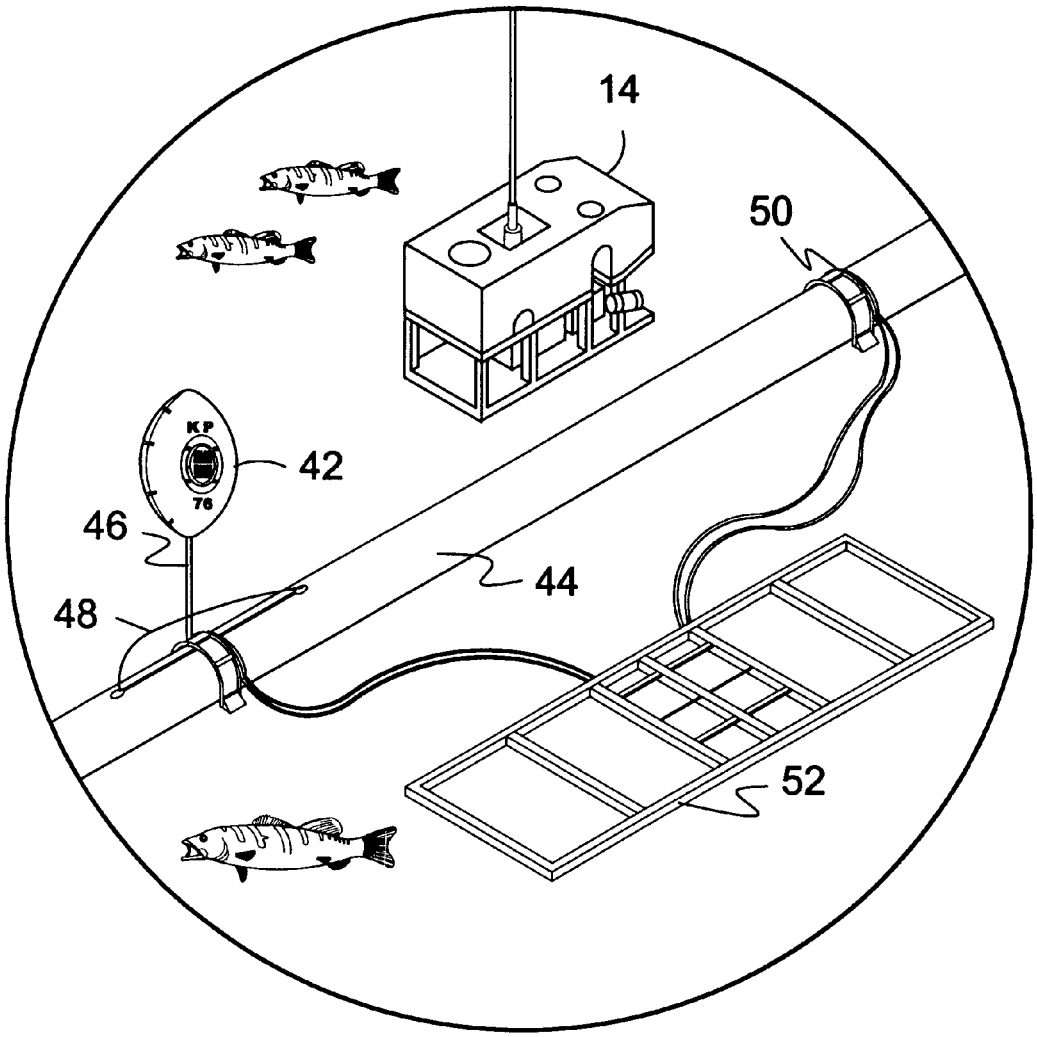
FIG. 5 is an illustrative view of the present invention having a buoyant readout module.

Turning to FIG. 5, shown therein is an illustrative view of the present invention having a buoyant readout module. Depicted in FIG. 5 is the buoyant readout module 42 of the present invention's subsea solar powered permanent cathodic protection test station. The buoyant readout module 42 allows the solar powered meter to be positioned away from the monitored equipment, e.g., a subsea pipeline 44, within a buoyant housing. A tether 46 carries the wires to the sensors 48 deployed on or around the equipment being monitored. Also shown are subsea ROV 14, clamp 50 and CP anode sled 52.

Figure 6:
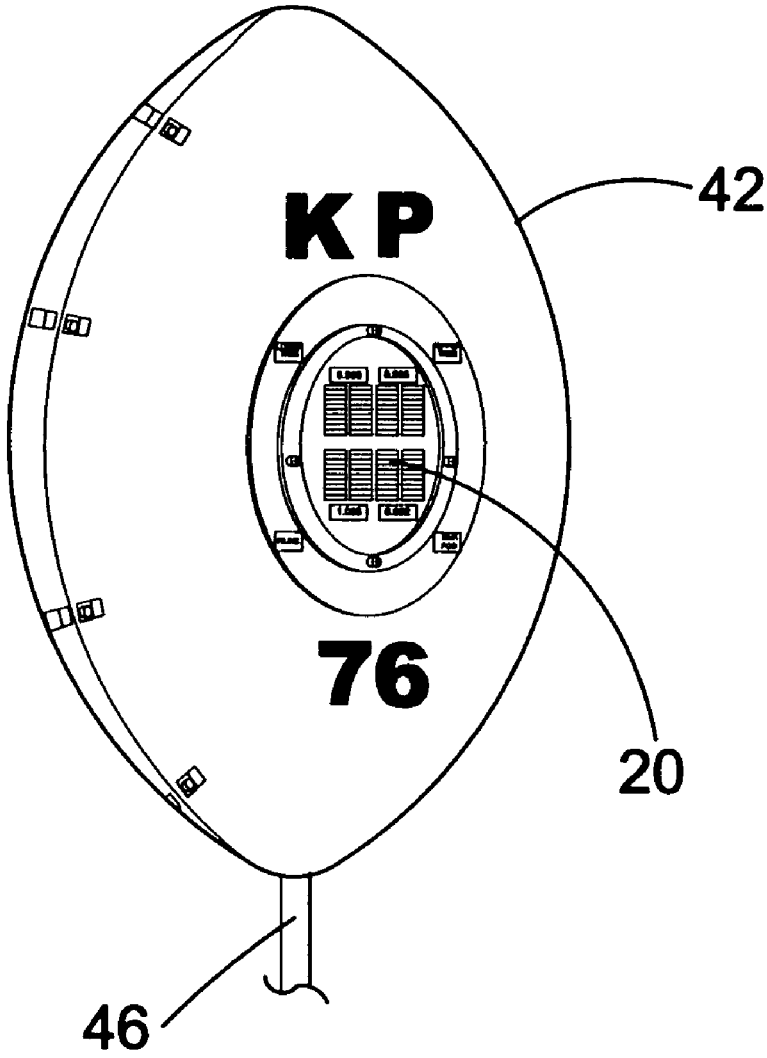
FIG. 6 is a detailed view of the buoyant readout module of the present invention.

Turning to FIG. 6, shown therein is a detailed view of the buoyant module of the present invention. Depicted in FIG. 6 is the buoyant module 42 of the present invention's subsea solar powered permanent cathodic protection test station. A CP test station readout 20 on the buoyant module 42 allows the solar powered meter to be positioned away from the monitored equipment within a buoyant housing. A tether 46 carries the wires to the sensors deployed on or around the equipment being monitored.

Figure 7:
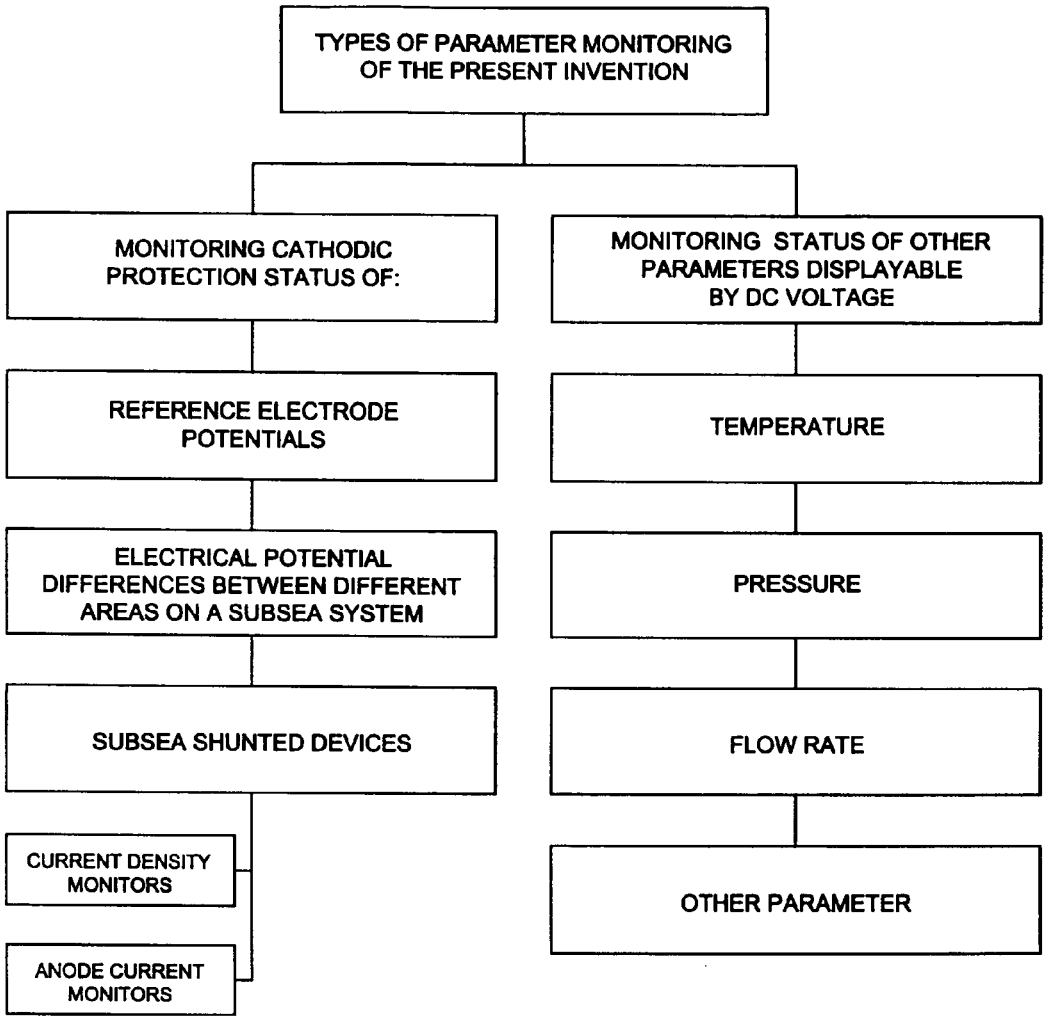
FIG. 7 is a block diagram of the types of parameters being monitored by the test station of the present invention.

Turning to FIG. 7, shown therein is a block diagram of the types of parameters being monitored by the test station of the present invention. Depicted in FIG. 7 are the integral voltmeters which are powered with independent solar panels include displayed parameters for monitoring cathodic protection status such as reference electrode potentials, subsea shunted devices such as, current density and anode current. In addition to monitoring cathodic protection status parameters, the solar powered test station may be utilized to monitor any other parameters that can be displayed as a DC voltage. Such parameters include, but are not limited to temperature, pressure, or flow rate.

I claim:

1. A subsea apparatus for monitoring a subsea structure, the apparatus being solar-panel powered, comprising:

a) a monitoring station being disposed on the subsea structure so that the subsea structure can be monitored for a parameter;

b) said monitoring station having an electrical circuit;

c) an input sensor for monitoring the subsea structure for the parameter and providing an input signal to said electrical circuit;

d) a voltage readout for displaying said parameter as a function of voltage;

e) wherein said electrical circuit converts said input signal to a suitable voltage for display by the voltage readout; and, f) a subsea solar panel for providing power to said electrical circuit, said solar panel receiving light from an artificial subsea source.

2. The apparatus of claim 1, further comprising a subsea buoyant member that contains said voltage readout, wherein said subsea buoyant member is positioned away from the subsea structure.

3. The apparatus of claim 2, further comprising a tether that connects said subsea buoyant member to the subsea structure, said tether electrically connecting said input sensors to said electrical circuit.

4. The apparatus of claim 2, further comprising a waterproof pressure housing for containing said voltage readout.

5. The apparatus of claim 4, wherein the pressure housing has a face with an identification bezel and a lens disposed in said bezel.

6. The apparatus of claim 5, wherein the pressure housing has a retainer ring that mechanically connects said lens to said pressure housing.

7. The apparatus of claim 1, wherein said input sensor monitors for cathodic protection.

8. The apparatus of claim 1, wherein said input sensor monitors for temperature.

9. The apparatus of claim 1, wherein said input sensor monitors for pressure.

10. The apparatus of claim 1, wherein said input sensor monitors for flow rate.

11. The apparatus of claim 1, wherein said input sensor comprises a ground reference.

12. The apparatus of claim 11, wherein said ground reference comprises a reference electrode.

13. The apparatus of claim 1, wherein said voltage readout displays reference potentials.

14. The apparatus of claim 1, wherein said voltage readout displays current density.

15. The apparatus of claim 1, wherein said voltage readout displays anode current.

16. The apparatus of claim 1, wherein the monitoring station has a plurality of solar panels.

17. The apparatus of claim 1, wherein the monitoring station has a plurality of voltage readouts.

18. The apparatus of claim 1, wherein the monitoring station has a plurality of input sensors.

19. The apparatus of claim 1, wherein the monitoring station has means for electrical interconnection of said input sensor to said electrical circuit.

20. The apparatus of claim 19, wherein said means for electrical interconnection comprises a junction box.

21. The apparatus of claim 1, wherein said monitoring station is incorporated into the subsea structure.

22. A subsea apparatus for monitoring a subsea structure, the apparatus being solar panel powered, comprising:

a) a monitoring station disposed on a subsea structure that monitors the subsea structure for at least one parameter;

b) an electrical circuit integrated with the monitoring station;

c) at least one input sensor connected to the monitoring station that provides an input signal to the electrical circuit;

d) a voltage readout that displays the parameters;

e) a subsea solar panel connected to the electrical circuit, and f) an artificial subsea light source that powers the solar panel.

* * * * *